United States Patent [19]

Masumoto et al.

[11] Patent Number: 4,990,198

[45] Date of Patent: Feb. 5, 1991

[54] HIGH STRENGTH MAGNESIUM-BASED AMORPHOUS ALLOY

[75] Inventors: Tsuyoshi Masumoto; Akihisa Inoue, both of Sendai; Katsumasa Odera, Kurobe, all of Japan

[73] Assignee: Yoshida Kogyo K. K., Tokyo, Japan

[21] Appl. No.: 398,993

[22] Filed: Aug. 28, 1989

[30] Foreign Application Priority Data

| | | | |
|---|---|---|---|
| Sep. 5, 1988 | [JP] | Japan | 63-220427 |
| Mar. 8, 1989 | [JP] | Japan | 1-177974 |
| Jul. 12, 1989 | [JP] | Japan | 1-53885 |

[51] Int. Cl.[5] ..... C22C 45/00

[52] U.S. Cl. ..... 148/403

[58] Field of Search ..... 148/403; 420/402, 405, 420/407, 408, 411

[56] References Cited

U.S. PATENT DOCUMENTS

| | | | |
|---|---|---|---|
| 4,413,561 | 2/1984 | Ovshinsky et al. | 420/402 |
| 4,675,157 | 6/1987 | Das et al. | 420/405 |
| 4,765,954 | 8/1988 | Das et al. | 420/405 |
| 4,767,678 | 8/1988 | Yates et al. | 148/403 |
| 4,770,850 | 9/1988 | Hehmann et al. | 420/402 |

*Primary Examiner*—Melvyn J. Andrews

*Attorney, Agent, or Firm*—Hill, Van Santen, Steadman & Simpson

[57] ABSTRACT

The present invention provides high strength magnesium-based alloys which are at least 50% by volume composed of an amorphous phase, the alloys having a composition represented by the general formula (I) $Mg_aX_b$; (II) $Mg_aX_cM_d$, (III) $Mg_aX_cLn_e$; or (IV) $Mg_aX_cM_dLn_e$ (wherein X is elements selected from the group consisting of Cu, Ni, Sn and Zn; M is one or more elements selected from the group consisting of Al, Si and Ca; Ln is one or more elements selected from the group consisting of Y, La, Ce, Nd and Sm or a misch metal rare earth elements; and a, b, c, d and e are atomic percentages falling within the following ranges: $40 \leqq a \leqq 90$; $10 \leqq b \leqq 60$, $4 \leqq c \leqq 35$, $2 \leqq d \leqq 25$, and $4 \leqq e \leqq 25$. Since the magnesium-based alloys have high hardness, high strength and high corrosion-resistance, they are very useful in various applications. Further, since their alloys exhibit superplasticity near the crystallization temperature, they can be processed into various bulk materials, for example, by extrusion, press working or hot-forging at the temperatures of the crystallization temperature ±100° C.

4 Claims, 1 Drawing Sheet

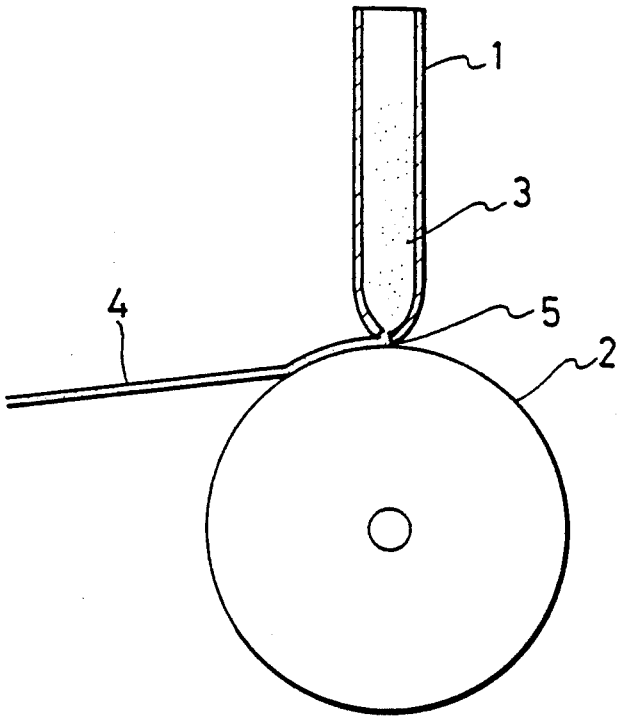
1
3
4
5
2

HIGH STRENGTH MAGNESIUM-BASED AMORPHOUS ALLOY

BACKGROUND OF THE INVENTION

1. Field of the Invention

The present invention relates to magnesium-based alloys which have high levels of hardness and strength together with superior corrosion resistance.

2. Description of the Prior Art

As conventional magnesium-based alloys, there have been known Mg-Al, Mg-Al-Zn, Mg-Th-Zr, Mg-Th-Zn-Zr, Mg-Zn-Zr, Mg-Zn-Zr-RE (rare earth element), etc. and these known alloys have been extensively used in a wide variety of applications, for example, as light-weight structural component materials for aircrafts and automobiles or the like, cell materials and sacrificial anode materials, according to their properties.

However, the conventional magnesium-based alloys as set forth above are low in hardness and strength and also poor in corrosion resistance.

SUMMARY OF THE INVENTION

In view of the foregoing, it is an object of the present invention to provide novel magnesium-based alloys at relatively low cost which have an advantageous combination of properties of high hardness, high strength and high corrosion resistance and which can be subjected to extrusion, press working, a large degree of bending or other similar operations.

According to the present invention, there are provided the following high strength magnesium-based alloys:

(1) High strength magnesium-based alloys at least by volume of which is amorphous, the magnesium-based alloys having a composition represented by the general formula (I):

$$Mg_aX_b \quad (I)$$

wherein: X is at least two elements selected from the group consisting of Cu, Ni, Sn and Zn; and a and b are atomic percentages falling within the following ranges:

$$40 \leqq a \leqq 90 \text{ and } 10 \leqq b \leqq 60.$$

(2) High strength magnesium-based alloys at least by volume of which is amorphous, the magnesium-based alloys having a composition represented by the $$Mg_aX_cMd \quad (II)$$

wherein:

X is one or more elements selected from the group consisting of Cu, Ni, Sn and Zn; M is one or more elements selected from the group consisting of Al, Si and Ca; and a, c and d are atomic percentages falling within the following ranges:

$$40 \leqq a \leqq 90,\ 4 \leqq c \leqq 35 \text{ and } 2 \leqq d \leqq 25.$$

(3) High strength magnesium-based alloys at least by volume of which is amorphous, the magnesium-based alloys having a composition represented by the general formula (III):

$$Mg_aX_cLn_e \quad (III)$$

wherein X is one or more elements selected from the group consisting of Cu, Ni, Sn and Zn; Ln is one or more elements selected from the group consisting of Y, La, Ce, Nd and Sm or a misch metal (Mm) of rare earth elements; and a, c and e are atomic percentages falling within the following ranges:

$$40 \leqq a \leqq 90,\ 4 \leqq c \leqq 35 \text{ and } 4 \leqq e \leqq 25.$$

(4) High strength magnesium-based alloys at least by volume of which is amorphous, the magnesium-based alloys having a composition represented by the general formula (IV):

$$Mg_aX_cM_dLn_e \quad (IV)$$

wherein:

X is one or more elements selected from the group consisting of Cu, Ni, Sn and Zn;

M is one or more elements selected from the group consisting of Al, Si and Ca;

Ln is one or more elements selected from the group consisting of Y, La, Ce, Nd and Sm or a misch metal (Mm) of rare earth elements; and a, c, d and e are atomic percentages falling within the following ranges:

$$40 \leqq a \leqq 90,\ 4 \leqq c \leqq 35,\ 2 \leqq d \leqq 25 \text{ and } 4 \leqq e \leqq 25.$$

The magnesium-based alloys of the present invention are useful as high hardness materials, high strength materials and high corrosion resistant materials. Further, the magnesium-based alloys are useful as high-strength and corrosion-resistant materials for various applications which can be successfully processed by extrusion, press working or the like and can be subjected to a large degree of bending.

BRIEF DESCRIPTION OF THE DRAWING

The single FIGURE is a schematic illustration of a single roller-melting apparatus employed to prepare thin ribbons from the alloys of the present invention by a rapid solidification process.

DETAILED DESCRIPTION OF THE PREFERRED EMBODIMENTS

The magnesium-based alloys of the present invention can be obtained by rapidly solidifying a melt of an alloy having the composition as specified above by means of liquid quenching techniques. The liquid quenching techniques involve rapidly cooling a molten alloy and, particularly, single-roller melt-spinning technique, twin-roller melt-spinning technique and in- rotating-water melt-spinning technique are mentioned as especially effective examples of such techniques. In these techniques, the cooling rate of about $10^4$ to $10^6$ K/sec can be obtained. In order to produce thin ribbon materials by the single-roller melt-spinning technique, twin-roller melt-spinning technique or the like, the molten alloy is ejected from the opening of a nozzle to a roll of, for example, copper or steel, with a diameter of about 30–3000 mm, which is rotating at a constant rate of about 300–10000 rpm. In these techniques, various thin ribbon materials with a width of about 1–300 mm and a thickness of about 5–500 μm can be readily obtained. Alternatively, in order to produce wire materials by the in-rotating-water melt-spinning technique, a jet of the molten alloy is directed, under application of the back pressure of argon gas, through a nozzle into a liquid refrigerant layer with a depth of about 1 to 10 cm which is held by centrifugal force in a drum rotating at a rate of about 50 to 500 rpm. In such a manner, fine wire materials can be readily obtained. In this technique, the angle between the molten alloy ejecting from the nozzle and the liquid refrigerant surface is preferably in the range of about 60° to 90° and the ratio of the relative velocity of the ejecting molten alloy to the liquid refrigerant surface is preferably in the range of about 0.7 to 0.9.

Besides the above techniques, the alloy of the present invention can be also obtained in the form of thin film by a sputtering process. Further, rapidly solidified powder of the alloy composition of the present invention can be obtained by various atomizing processes, for example, high pressure gas atomizing process or spray process.

Whether the rapidly solidified magnesium-based alloys thus obtained are amorphous or not can be known by an ordinary X-ray diffraction method because an amorphous structure provides characteristic halo patterns. The amorphous structure can be achieved by the above-mentioned single-roller melt-spinning, twin-roller melt-spinning process, in-rotating-water melt spinning process, sputtering process, various atomizing processes, spray process, mechanical alloying processes, etc. The amorphous structure is transformed into a crystalline structure by heating to a certain temperature and such a transition temperature is called crystallization temperature Tx".

In the magnesium-based alloys of the present invention represented by the above general formula (I), a is limited to the range of 40 to 90 atomic % and b is limited to the range of 10 to 60 atomic %. The reason for such limitations is that when a and b stray from the respective ranges, the formation of the amorphous structure becomes difficult or the resulting alloys become brittle. Therefore, the intended alloys having the properties contemplated by the present invention can not be obtained by industrial rapid cooling techniques using the above-mentioned liquid quenching, etc.

In the magnesium-based alloys of the present invention represented by the above general formula (II), a, c and d are limited to the ranges of 40 to 90 atomic %, 4 to 35 atomic % and 2 to 25 atomic %, respectively. The reason for such limitations is that when a, c and d stray from the respective ranges, the formation of the amorphous structure becomes difficult or the resulting alloys become brittle. Therefore, the intended alloys having the properties contemplated by the present invention can not be obtained by industrial rapid cooling techniques using the above-mentioned liquid quenching, etc.

In the magnesium-based alloys of the present invention represented by the above general formula (III), a is limited to the range of 40 to 90 atomic %, c is limited to the range of 4 to 35 atomic % and e is limited to the range of 4 to 25 atomic %. The reason for such limitations is that when a, c and e stray from the respective ranges, the formation of the amorphous structure becomes difficult or the resulting alloys become brittle. Therefore, the intended alloys having the properties contemplated by the present invention can not be obtained by industrial rapid cooling techniques using the above-mentioned liquid quenching, etc.

Further, in the magnesium-based alloys of the present invention represented by the above general formula (IV), a, c, d and e should be limited within the ranges of 40 to 90 atomic %, 4 to 35 atomic %, 2 to 25 atomic % and 4 to 25 atomic %, respectively. The reason for such limitations is that when a, c, d and e stray from the specified ranges, the formation of the amorphous structure becomes difficult or the resulting alloys become brittle. Therefore, the intended alloys having the properties contemplated by the present invention can not be obtained by industrial rapid cooling techniques using the above-mentioned liquid quenching, etc.

Element X is one or more elements selected from the group consisting of Cu, Ni, Sn and Zn and these elements provide not only a superior ability to produce an amorphous structure but also a considerably improved strength while retaining the ductility.

Element M which is one or more elements selected from the group consisting of Al, Si and Ca has a strength improving effect without adversely affecting the ductility. Further, among the elements X, elements Al and Ca have an effect of improving the corrosion resistance and element Si improves the crystallization temperature Tx, thereby enhancing the stability of the amorphous structure at relatively high temperatures and improving the flowability of the molten alloy.

Element Ln is one or more elements selected from the group consisting of Y, La, Ce, Nd and Sm or a misch metal (Mm) consisting of rare earth elements and these elements are effective to improve the ability to produce an amorphous structure. Particularly, when the elements Ln are coexistent with the foregoing elements X, the ability to form amorphous structure is further improved.

The foregoing misch metal (Mm) is a composite consisting of 40 to 50% Ce and 20 to 25% La, the balance consisting of other rare earth elements (atomic number: 59 to 71) and tolerable levels of impurities such as Mg, Al, Si, Fe, etc. The misch metal (Mm) may be used in place of the other elements represented by Ln in almost the same proportion (by atomic %) with a view to improving the ability to develop an amorphous structure. The use of the misch metal as a source material for the alloying element Ln will give an economically merit because of its low cost.

Further, since the magnesium-based alloys of the present invention exhibit superplasticity in the vicinity of their crystallization temperatures (crystallization temperature Tx±100° C.), they can be readily subjected to extrusion, press working, hot forging, etc. Therefore, the magnesium-based alloys of the present invention obtained in the form of thin ribbon, wire, sheet or powder can be successfully processed into bulk materials by way of extrusion, press working, hot-forging, etc., at the temperature within the temperature range of Tx ±100° C. Further, since the magnesium-based alloys of the present invention have a high degree of toughness, some of them can be subjected to bending of 180° without fracture.

Now, the advantageous features of the magnesium-based alloys of the present invention will be described with reference to the following examples.

EXAMPLE

Molten alloy 3 having a predetermined composition was prepared using a high-frequency melting furnace and was charged into a quartz tube 1 having a small opening 5 (diameter: 0.5 mm) at the tip thereof, as shown in the drawing. After heating to melt the alloy, 3 the quartz tube 1 was disposed right above a copper roll 2. Then, the molten alloy 3 contained in the quartz tube 1 was ejected from the small opening 5 of the quartz tube 1 under the application of an argon gas pressure of 0.7 kg/cm$^2$ and brought into contact with the surface of the roll 2 rapidly rotating at a rate of 5,000 rpm. The molten alloy 3 was rapidly solidified and an alloy thin ribbon 4 was obtained.

According to the processing conditions as described above, there were obtained 71 kinds of alloy thin ribbons (width: 1 mm, thickness: 20 μm) having the compositions (by at.%) as shown in Table. The thin ribbons thus obtained were each subjected to X-ray diffraction analysis. It has been confirmed that an amorphous phase is formed in the resulting thin ribbons.

Crystallization temperature (Tx) and hardness (Hv) were measured for each test specimen of the thin ribbons and the results are shown in a right column of the table. The hardness (Hv) is indicated by values (DPN) measured using a Vickers micro hardness tester under load of 25 g. The crystallization temperature (Tx) is the starting temperature (K) of the first exothermic peak on the differential scanning calorimetric curve which was obtained at a heating rate of 40 K/min. In Table, "Amo" represents an amorphous structure and "Amo+Cry" represents a composite structure of an amorphous phase and a crystalline phase. "Bri" and "Duc" represent "brittle" and "ductile" respectively.

As shown in Table, it has been confirmed that the test specimens of the present invention all have a high crystallization temperature of the order of at least 420 K and, with respect to the hardness Hv (DPN), all test specimens are on the high order of at least 160 which is about 2 to 3 times the hardness Hv (DPN), i.e., 20–90, of the conventional magnesium-based alloys. Further, it has been found that addition of Si to ternary system alloys of Mg-Ni-Ln and Mg-Cu-Ln results in a significant increase in the crystallization temperature Tx, and the stability of the amorphous structure is improved.

TABLE

| No. | Composition | Structure | Tx (K) | Hv (DPN) | |
|---|---|---|---|---|---|
| 1 | $Mg_{85}Ni_{10}Ce_5$ | Amo | 450 | 170 | Duc |
| 2 | $Mg_{85}Ni_5Ce_{10}$ | Amo | 453 | 182 | Duc |
| 3 | $Mg_{85}Ni_{7.5}Ce_{7.5}$ | Amo | 473 | 188 | Duc |
| 4 | $Mg_{80}Ni_{10}Ce_{10}$ | Amo | 474 | 199 | Duc |
| 5 | $Mg_{70}Ni_{20}Ce_{10}$ | Amo | 465 | 199 | Duc |
| 6 | $Mg_{75}NiCe_{10}$ | Amo | 488 | 229 | Duc |
| 7 | $Mg_{75}Ni_{10}Ce_{15}$ | Amo | 473 | 194 | Duc |
| 8 | $Mg_{75}Ni_{20}Ce_5$ | Amo | 457 | 188 | Duc |
| 9 | $Mg_{60}Ni_{20}Ce_{20}$ | Amo | 485 | 228 | Duc |
| 10 | $Mg_{50}Ni_{30}Ce_{20}$ | Amo | 485 | 245 | Duc |
| 11 | $Mg_{60}Ni_{30}Ce_{10}$ | Amo | 456 | 191 | Duc |
| 12 | $Mg_{90}Cu_5Ce_5$ | Amo | 432 | 163 | Duc |
| 13 | $Mg_{85}Cu_{7.5}Ce_{7.5}$ | Amo | 457 | 180 | Duc |
| 14 | $Mg_{80}Cu_{10}Ce_{10}$ | Amo | 470 | 188 | Duc |
| 15 | $Mg_{75}Cu_{12.5}Ce_{12.5}$ | Amo | 475 | 199 | Duc |
| 16 | $Mg_{75}Cu_{10}Ce_{15}$ | Amo | 483 | 194 | Duc |
| 17 | $Mg_{70}Cu_{20}Ce_{10}$ | Amo | 474 | 188 | Duc |
| 18 | $Mg_{70}Cu_{10}Ce_{20}$ | Amo | 435 | 199 | Duc |
| 19 | $Mg_{60}Cu_{20}Ce_{20}$ | Amo | 485 | 190 | Bri |
| 20 | $Mg_{75}Ni_{10}Si_5Ce_{10}$ | Amo | 523 | 195 | Duc |
| 21 | $Mg_{60}Ni_{10}Si_8Ce_{22}$ | Amo | 535 | 225 | Bri |
| 22 | $Mg_{60}Ni_{15}Si_{15}Ce_{10}$ | Amo | 510 | 210 | Bri |
| 23 | $Mg_{80}Ni_5Si_5Ce_{10}$ | Amo | 480 | 199 | Duc |
| 24 | $Mg_{75}Cu_5Si_5Ce_{15}$ | Amo | 518 | 203 | Duc |
| 25 | $Mg_{85}Cu_5Si_3Ce_7$ | Amo | 483 | 185 | Duc |
| 26 | $Mg_{65}Ni_{25}La_{10}$ | Amo | 440 | 220 | Duc |
| 27 | $Mg_{70}Ni_{25}La_5$ | Amo | 442 | 205 | Duc |
| 28 | $Mg_{60}Ni_{20}La_{20}$ | Amo | 453 | 210 | Duc |
| 29 | $Mg_{80}Ni_{15}La_5$ | Amo | 430 | 199 | Duc |
| 30 | $Mg_{70}Ni_{20}La_5Ce_5$ | Amo | 435 | 200 | Duc |
| 31 | $Mg_{70}Ni_{10}La_{10}Ce_{10}$ | Amo | 440 | 225 | Duc |
| 32 | $Mg_{75}Ni_{10}La_5Ce_{10}$ | Amo | 436 | 220 | Duc |
| 33 | $Mg_{80}Ni_5La_5Ce_{10}$ | Amo | 473 | 194 | Duc |
| 34 | $Mg_{90}Ni_5La_5$ | Amo + Cry | — | 180 | Duc |
| 35 | $Mg_{75}Ni_{10}Y_{15}$ | Amo | 440 | 230 | Bri |
| 36 | $Mg_{70}Ni_{20}Y_{10}$ | Amo | 485 | 225 | Duc |
| 37 | $Mg_{50}Ni_{30}La_5Ce_{10}Sm_5$ | Amo | 490 | 245 | Bri |
| 38 | $Mg_{60}Ni_{20}La_5Ce_{10}Nd_5$ | Amo | 470 | 220 | Duc |
| 39 | $Mg_{70}Ni_{10}Al_5La_{15}$ | Amo | 445 | 210 | Duc |
| 40 | $Mg_{70}Ni_{15}Al_5La_{10}$ | Amo | 453 | 210 | Duc |
| 41 | $Mg_{70}Ni_{10}Ca_5La_{15}$ | Amo | 425 | 199 | Duc |
| 42 | $Mg_{75}Ni_{10}Zn_5La_{10}$ | Amo | 435 | 240 | Duc |
| 43 | $Mg_{90}Cu_5La_5$ | Amo | 435 | 165 | Duc |
| 44 | $Mg_{85}Cu_{10}La_5$ | Amo | 457 | 180 | Duc |
| 45 | $Mg_{80}Cu_{10}La_{10}$ | Amo | 455 | 188 | Duc |
| 46 | $Mg_{75}Cu_{10}La_{15}$ | Amo | 470 | 205 | Duc |
| 47 | $Mg_{70}Cu_{20}La_{10}$ | Amo | 470 | 200 | Duc |
| 48 | $Mg_{70}Cu_{15}La_{15}$ | Amo | 474 | 195 | Duc |
| 49 | $Mg_{70}Cu_{10}La_{20}$ | Amo | 465 | 205 | Duc |
| 50 | $Mg_{60}Cu_{20}La_{20}$ | Amo | 485 | 220 | Bri |
| 51 | $Mg_{50}Cu_{30}La_{20}$ | Amo | 473 | 210 | Bri |
| 52 | $Mg_{75}Cu_{10}La_5Ce_{10}$ | Amo | 480 | 195 | Duc |
| 53 | $Mg_{60}Cu_{18}La_7Ce_{15}$ | Amo | 476 | 205 | Duc |
| 54 | $Mg_{60}Cu_{13}Al_5La_7Ce_{15}$ | Amo | 490 | 210 | Bri |
| 55 | $Mg_{60}Cu_{13}Ca_5La_7Ce_{15}$ | Amo | 470 | 199 | Duc |
| 56 | $Mg_{75}Cu_{15}Nd_{10}$ | Amo | 471 | 185 | Duc |
| 57 | $Mg_{85}Cu_{10}Sm_5$ | Amo | 482 | 187 | Duc |
| 58 | $Mg_{80}Cu_{10}Y_{10}$ | Amo | 465 | 225 | Bri |
| 59 | $Mg_{75}Cu_{10}Y_{15}$ | Amo | 455 | 237 | Bri |
| 60 | $Mg_{75}Cu_{10}Sn_5La_{10}$ | Amo | 435 | 198 | Bri |
| 61 | $Mg_{70}Ni_5Cu_5La_{20}$ | Amo | 473 | 210 | Bri |
| 62 | $Mg_{70}Ni_{10}Cu_{10}La_{10}$ | Amo | 465 | — | Bri |
| 63 | $Mg_{70}Ni_{15}Si_5La_{10}$ | Amo | 512 | 205 | Bri |
| 64 | $Mg_{70}Cu_{15}Si_5La_{10}$ | Amo | 520 | 210 | Bri |
| 65 | $Mg_{75}Zn_{15}Ce_{10}$ | Amo | 456 | 203 | Duc |
| 66 | $Mg_{70}Zn_{15}Mm_{15}$ | Amo | 465 | 214 | Duc |
| 67 | $Mg_{75}Sn_{10}Ce_{15}$ | Amo | 423 | 170 | Duc |
| 68 | $Mg_{70}Sn_{10}Mm_{20}$ | Amo | 435 | 185 | Duc |
| 69 | $Mg_{70}Zn_{20}Sn_{10}$ | Amo | 455 | 197 | Bri |
| 70 | $Mg_{80}Ni_{10}Al_5Ca_5$ | Amo | 437 | 186 | Duc |
| 71 | $Mg_{80}Cu_{10}Al_5Si_5$ | Amo | 453 | 198 | Duc |

In the above example, all of the specimens, except specimen No. 34, have an amorphous structure. However, there are also partially amorphous alloys which are at least 50% by volume composed of an amorphous structure and such alloys can be obtained, for example, in the compositions of $Mg_{70}Ni_{10}Ce_{20}$, $Mg_{90}Ni_5Ce_5$, $Mg_{65}Ni_{30}Ce_5$, $Mg_{75}Ni_5Ce_{20}$, $Mg_{60}Cu_{20}Ce_{20}$, $Mg_{90}Ni_5La_5$, $Mg_{50}Cu_{20}Si_8Ce_{22}$, etc.

The above specimen No. 4 was subjected to corrosion test. The test specimen was immersed in an aqueous solution of HCl (0.01N) and an aqueous solution of NaOH (0.25N), both at room temperature, and corrosion rates were measured by the weight loss due to dissolution. As a result of the corrosion test, there were obtained 89.2 mm/year and 0.45 mm/year for the respective solutions and it has been found that the test specimen has no resistance to the aqueous solution of HCl, but has a high resistance to the aqueous solution of NaOH. Such a high corrosion resistance was achieved for the other specimens.

What is claimed is:

1. A high strength magnesium-based alloy at least 50% by volume of which is amorphous, said magnesium-based alloy having a composition represented by the general formula (I):

$$Mg_aX_b \quad (I)$$

wherein:

X is at least two elements selected from the group consisting of Cu, Ni, Sn and Zn; and a and b are atomic percentages falling within the following ranges:

$40 \leqq a \leqq 90$ and $10 \leqq b \leqq 60$.

2. A high strength magnesium-based alloy at least by volume of which is amorphous, said magnesium-based alloy having a composition represented by the general formula (II):

$$Mg_aX_cM_d \quad (II)$$

wherein:

X is one or more elements selected from the group consisting of Cu, Ni, Sn and Zn;

M is one or more elements selected from the group consisting of Al, Si and Ca;

and a, c and d are atomic percentages falling within the following ranges:

$40a \leqq 90$, $4 \leqq c \leqq 35$ and $2 \leqq d \leqq 25$.

3. A high strength magnesium-based alloy at least 50% by volume of which is amorphous, said magnesium-based alloy having a composition represented by the general formula (III):

$$Mg_aX_cLn_e \quad (III)$$

wherein:

X is one or more elements selected from the group consisting of Cu, Ni, Sn and Zn;

Ln is one or more elements selected from the group consisting of Y, La, Ce, Nd and Sm or a misch metal (Mm) of rare earth elements; and a, c and e are atomic percentages falling within the following ranges:

$40 \leqq a \leqq 90$, $4 \leqq c \leqq 35$ and $4 \leqq e \leqq 25$.

4. A high strength magnesium-based alloy at least by volume of which is amorphous, said magnesium-based alloy having a composition represented by the general formula (IV):

$$Mg_aX_cM_dLn_e \quad (IV)$$

wherein:

X is one or more elements selected from the group consisting of Cu, Ni, Sn and Zn;

M is one or more elements selected from the group consisting of Al, Si and Ca;

Ln is one or more elements selected from the group consisting of Y, La, Ce, Nd and Sm or a misch metal (Mm) of rare earth elements; and a, c, d and e are atomic percentages falling within the following ranges:

$40 \leqq a \leqq 90$, $4 \leqq c \leqq 35$, $2 \leqq d \leqq 25$ and $4 \leqq e \leqq 25$.

* * * * *